US011262057B2

(12) United States Patent
Hou et al.

(10) Patent No.: US 11,262,057 B2
(45) Date of Patent: Mar. 1, 2022

(54) LIGHTING APPARATUS

(71) Applicant: XIAMEN LEEDARSON LIGHTING CO., LTD, Fujian (CN)

(72) Inventors: Shouqiang Hou, Fujian (CN); Xiaoliang Wen, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 16/920,590

(22) Filed: Jul. 3, 2020

(65) Prior Publication Data

US 2021/0003273 A1 Jan. 7, 2021

(30) Foreign Application Priority Data

Jul. 3, 2019 (CN) ..... 201921028695.9
Jul. 3, 2019 (CN) ..... 201921029361.3

(51) Int. Cl.

| | |
|---|---|
| ***F21V 23/00*** | (2015.01) |
| ***F21V 23/06*** | (2006.01) |
| ***F21V 7/00*** | (2006.01) |
| ***F21V 21/40*** | (2006.01) |
| *F21Y 115/10* | (2016.01) |
| *F21S 8/02* | (2006.01) |

(52) U.S. Cl.

CPC ..... *F21V 23/002* (2013.01); *F21V 7/00* (2013.01); *F21V 21/40* (2013.01); *F21V 23/06* (2013.01); *F21S 8/02* (2013.01); *F21V 23/008* (2013.01); *F21Y 2115/10* (2016.08)

(58) Field of Classification Search

CPC ..... F21V 23/002; F21V 23/06

See application file for complete search history.

(56) References Cited

U.S. PATENT DOCUMENTS

| | | | | |
|---|---|---|---|---|
| 2010/0208474 | A1* | 8/2010 | Hancock | F21K 9/00 362/375 |
| 2012/0127740 | A1* | 5/2012 | Masuda | F21V 23/002 362/373 |
| 2012/0170248 | A1* | 7/2012 | Masuko | F21V 19/0005 362/95 |
| 2013/0155701 | A1* | 6/2013 | Osawa | F21V 29/70 362/382 |
| 2013/0201697 | A1* | 8/2013 | Osada | F21K 9/20 362/373 |
| 2013/0210252 | A1* | 8/2013 | Ilyes | H01R 24/38 439/226 |
| 2014/0204561 | A1* | 7/2014 | Hashimoto | F21K 9/232 362/95 |
| 2014/0204562 | A1* | 7/2014 | Mori | F21V 23/009 362/95 |

(Continued)

*Primary Examiner* — Bryon T Gyllstrom
*Assistant Examiner* — Christopher E Dunay
(74) *Attorney, Agent, or Firm* — Chun-Ming Shih; Lanway IPR Services

(57) ABSTRACT

A lighting apparatus includes a first conductive unit, an installation bracket, a second conductive unit, a light body and a top cover. The first conductive unit is used for connecting to an external power source. The installation bracket is fixed to an installation platform. The first conductive unit is disposed on a first side of the installation bracket. The top cover is used for disposing the second conductive unit and the light body. The top cover is detachably connected to the installation bracket from a second side of the installation bracket.

17 Claims, 11 Drawing Sheets

(56) References Cited

U.S. PATENT DOCUMENTS

| | | | | |
|---|---|---|---|---|
| 2014/0204594 | A1* | 7/2014 | Kanazawa | F21V 21/30 362/362 |
| 2016/0348861 | A1* | 12/2016 | Bailey | F21V 7/28 |
| 2018/0337496 | A1* | 11/2018 | McRae | H01R 13/648 |
| 2019/0234602 | A1* | 8/2019 | Eckert | F21V 23/006 |
| 2020/0059016 | A1* | 2/2020 | Kimmel | H02G 3/081 |

* cited by examiner

LIGHTING APPARATUS

FIELD

The present application is related to a lighting apparatus and more particularly related to a lighting apparatus with easy assembly structure.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

Downlight devices and panel light devices are popular and widely used in various places. In past time, people just expect the downlight devices for illumination. Now, people hope downlight devices to provide more flexible settings for different circumstances to bring a more convenient user experience. It is also important to provide a flexible and convenient way to assemble the lighting devices.

SUMMARY

In some embodiments, a lighting apparatus includes a first conductive unit, an installation bracket, a second conductive unit, a light body and a top cover.

The first conductive unit is used for connecting to an external power source, e.g. 110V/220V alternating power source or a direct current generated from a driver circuit.

The installation bracket is fixed to an installation platform, like a ceiling, a cavity of a ceiling, a junction box or a wall.

The first conductive unit is disposed on a first side of the installation bracket.

The light body includes a LED module for emitting a light. The top cover is used for disposing the second conductive unit and the light body. Specifically, the top cover may be integrated with a housing of the light body as a single body. In such case, the top cover is the top part of the light body. In some other embodiments, the top part of the light body may be an independent component from the top cover.

The LED module is electrically connected to the external power source via the second conductive unit and the first conductive unit. Specifically, the LED module may receive a driving current from a conductive path including the first conductive unit and the second conductive unit. In some embodiments, the conductive path only routes electricity to the LED module. In some other embodiments, the conductive path may also include a driver for converting the external power source into the driving current supplied to the LED module.

The top cover is detachably connected to the installation bracket from a second side of the installation bracket. The second side of the installation bracket is opposite to the first side of the installation bracket.

In some embodiments, the first conductive unit includes a through hole and a socket for connecting to a wire of the external power source, and the second conductive unit includes a conductive column.

In some embodiments, the first conductive unit further includes a conductive groove with a smaller diameter than the through hole. The conductive groove is electrically connected to the socket so as to connect to the wire providing the external power source.

In some embodiments, the conductive column has a bolt head for passing through the through hole from the second side of the installation bracket to the first side of the installation bracket. The top cover is rotated along the conductive groove to keep the bolt head above the conductive groove.

In some embodiments, the conductive column has a neck portion and a shoulder portion. The neck portion has a smaller dimension than the shoulder portion. The neck portion is kept in the conductive groove.

In some embodiments, the first conductive unit further includes a wiring structure for connecting to a wire of the external power source.

In some embodiments, the wiring structure includes a first part clipping an insulation layer of the wire and a second part clipping a conductive part of the wire.

In some embodiments, there are multiple through holes corresponding to multiple conductive columns. The multiple through holes are disposed symmetrically on the installation bracket.

In some embodiments, only a subset of the through holes are connected to the external power source. The LED module receives electricity if a corresponding subset of the conductive columns are electrically connected to the subset of the through holes. Specifically, the back cover may have multiple conductive columns and the installation bracket have multiple corresponding through holes. Not every pair of through holes and the conductive columns needs to provide electrical connection. For example, if there are four through holes and conductive columns. Only two through holes are connected to two terminals of the external power source. The other two through holes only provide structure connection for the top cover. The four conductive columns may all have electrical connection to the LED modules, but only two of the four conductive columns are actually electrically connected to the two through holes.

With such design, users do not need to identify the two through holes with electricity, but only need to place the four conductive columns into the four through holes. However, there are two conductive columns forming electrical connection to the two through holes actually connected to the external power source.

In some embodiments, the conductive column has two conductive parts respectively connecting to two terminals of the external power source.

In some embodiments, the first conductive unit further includes an elastic conductive clip clipping the conductive column.

In some embodiments, the through hole is disposed on a lateral wall of the installation bracket and the conductive column has an elastic unit for extending the conductive column into the through hole. Specifically, the conductive column is pressed to move along the lateral wall and then enters the through hole by releasing the elastic force of the elastic unit.

In some embodiments, the first conductive unit includes a conductive column on a second side of the installation bracket. The conductive column is connected to an external power source from a first side of the installation bracket. The second conductive unit includes a through hole for the conductive column to pass through.

In some embodiments, the light body further includes a lateral wall and a light passing cove. The lateral wall, the light passing cover and the top cover together form a container space for storing the LED module to emit the light passing through the light passing cover. Specifically, such embodiment may form a panel light.

In some embodiments, the light body has a reflective cup and a light opening. The light of the LED module is selected by the reflective cup escaping from the light opening. Specifically, the embodiment is a downlight apparatus.

In some embodiments, the installation bracket has a dorm part and a surface rim, the light body is placed inside the dorm part.

In some embodiments, the lighting apparatus may also include a driver disposed on the first side of the installation bracket.

In some embodiments, the lighting apparatus may also include a driver disposed between the top cover and the installation bracket.

In some embodiments, the installation bracket has a lateral wall surrounding the light body. Such design encloses the light body and provide protection for the light body.

In some embodiments, the light body has a collectable handle for rotating the top cover with respect to the installation bracket. For example, a foldable handle may be folded to be collected to a bottom surface of the light body. When the light body is to be installed, the foldable handle is unfolded for a hand of a user to hold for rotating the light body with respect to the installation bracket.

DETAILED DESCRIPTION

In some embodiments, a lighting apparatus includes a first conductive unit 7701, an installation bracket 7702, a second conductive unit 7704, a light body 7706 and a top cover 7705.

The first conductive unit 7701 is used for connecting to an external power source 7703, e.g. 110V/220V alternating power source or a direct current generated from a driver circuit.

The installation bracket 7702 is fixed to an installation platform 7708, like a ceiling, a cavity of a ceiling, a junction box or a wall.

The first conductive unit 7701 is disposed on a first side 7711 of the installation bracket 7702.

The light body 7706 includes a LED module 7707 for emitting a light. The top cover 7705 is used for disposing the second conductive unit 7704 and the light body 7706. Specifically, the top cover 7705 may be integrated with a housing of the light body as a single body. In such case, the top cover 7705 is the top part of the light body. In some other embodiments, the top part 7705 of the light body may be an independent component from the top cover.

The LED module 7707 is electrically connected to the external power source 7703 via the second conductive unit 7704 and the first conductive unit 7701. Specifically, the LED module may receive a driving current from a conductive path including the first conductive unit and the second conductive unit. In some embodiments, the conductive path only routes electricity to the LED module. In some other embodiments, the conductive path may also include a driver for converting the external power source into the driving current supplied to the LED module.

The top cover 7705 is detachably connected to the installation bracket 7702 from a second side 7709 of the installation bracket 7702. The second side 7709 of the installation bracket 7702 is opposite to the first side 7711 of the installation bracket 7702.

In some embodiments, the first conductive unit 7701 includes a through hole 7710 and a socket 7712 for connecting to a wire 7713 of the external power source 7703, and the second conductive unit 7704 includes a conductive column 7714.

Figure 2:
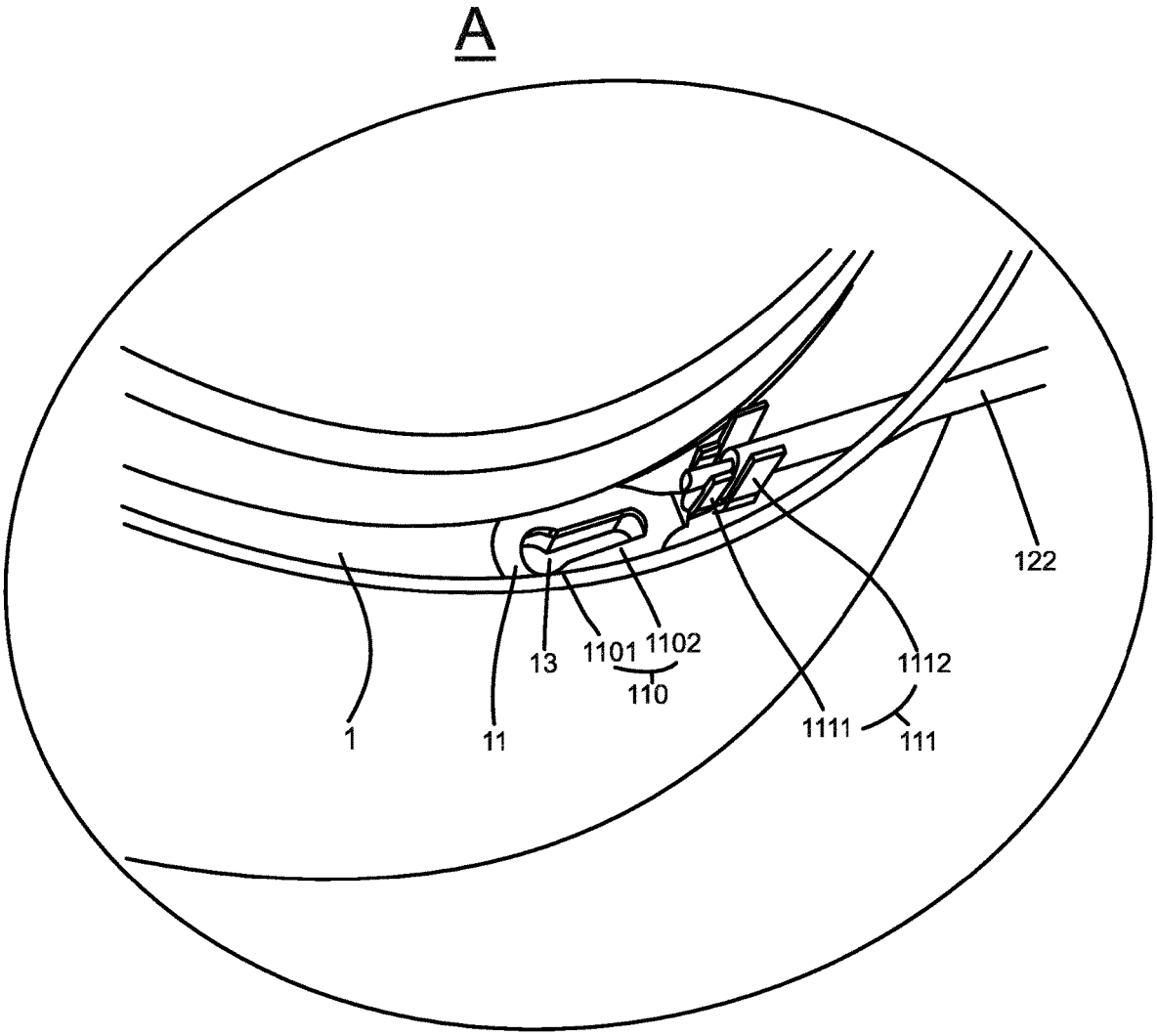
FIG. 2 illustrates a zoom-up view of a portion of the example in FIG. 1.

In FIG. 2, the first conductive unit further includes a conductive groove 1102 with a smaller diameter than the through hole 13. The conductive groove 1102 is electrically connected to the socket 111 so as to connect to the wire 122 providing the external power source.

Figure 3:
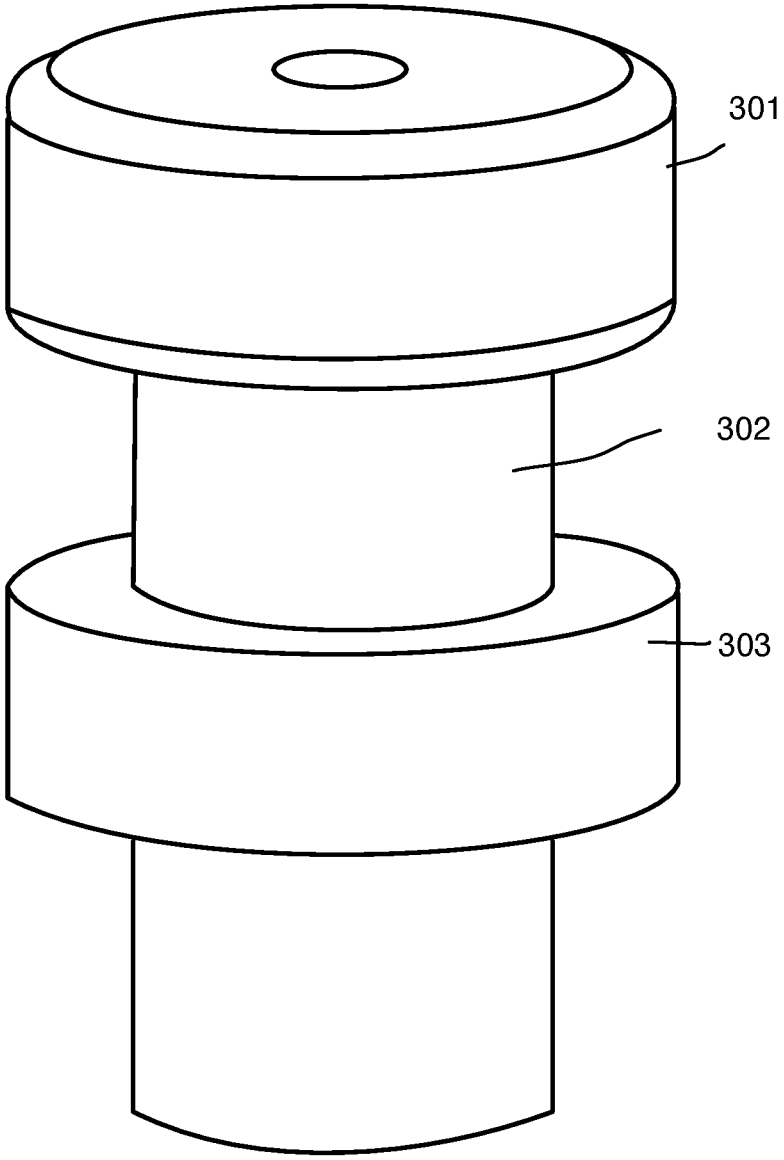
FIG. 3 illustrates a conductive column.
Figure 8:
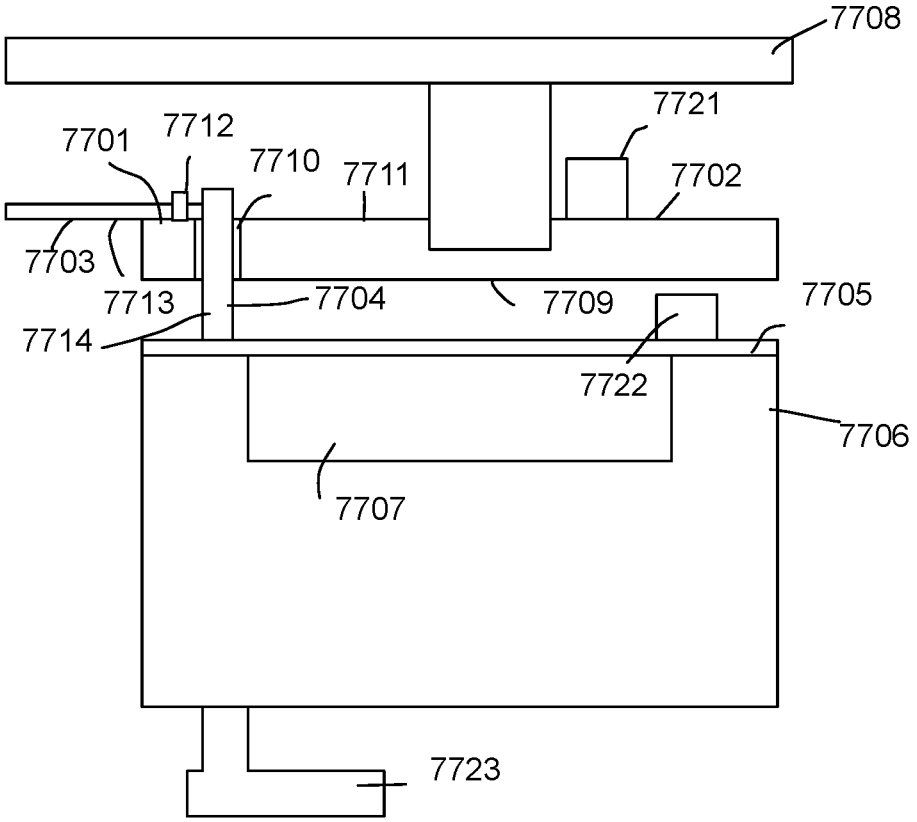
FIG. 8 illustrates a structure view of an embodiment.

In FIG. 8 and FIG. 3, the conductive column 7714 has a bolt head 301 for passing through the through hole 7710 from the second side 7709 of the installation bracket 7702 to the first side 7711 of the installation bracket 7702. The top cover 7705 is rotated along the conductive groove 1102 in FIG. 2 to keep the bolt head 301 in FIG. 3 above the conductive groove 1102 in FIG. 2.

In FIG. 3, the conductive column has a neck portion 302 and a shoulder portion 303. The neck portion 302 has a smaller dimension than the shoulder portion 303. The neck portion 302 is kept in the conductive groove.

In FIG. 2, the first conductive unit further includes a wiring structure 111 for connecting to a wire 122 of the external power source.

In FIG. 2, the wiring structure includes a first part 1112 clipping an insulation layer of the wire 122 and a second part 111 clipping a conductive part of the wire 122.

Figure 1:
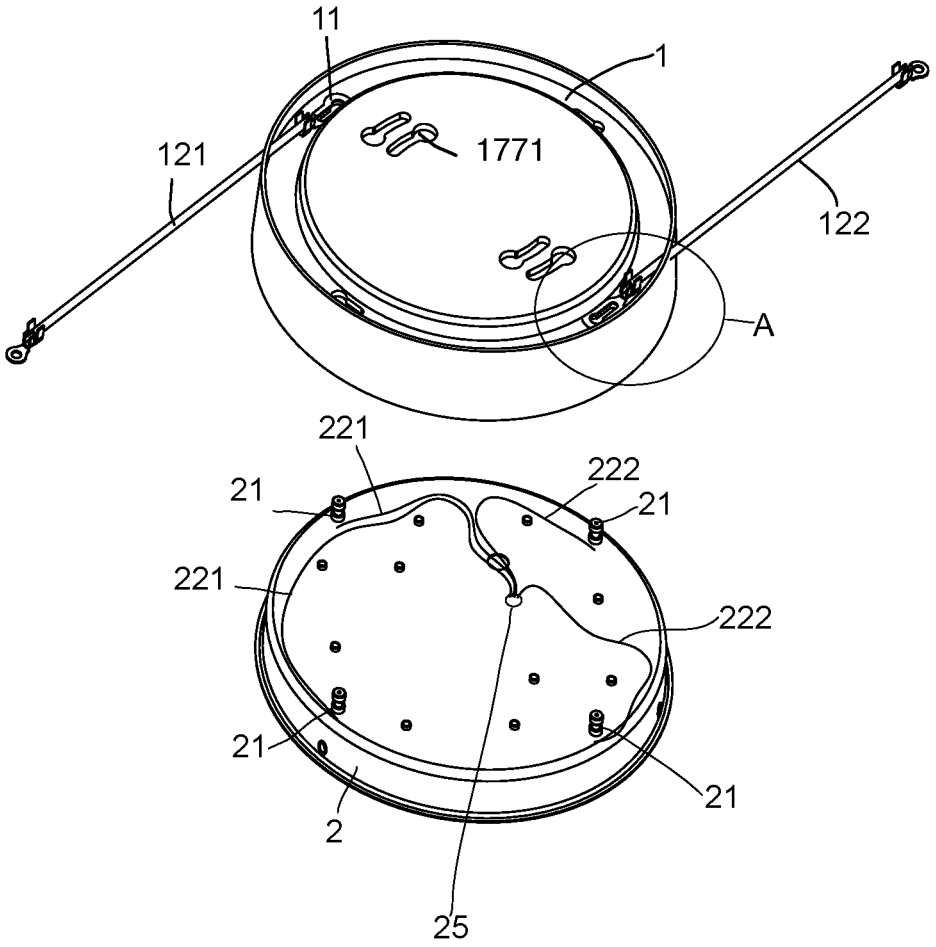
FIG. 1 illustrates a lighting apparatus with two parts.

In some embodiments, there are multiple through holes corresponding to multiple conductive columns, e.g. the example in FIG. 1. The multiple through holes are disposed symmetrically on the installation bracket.

In some embodiments, only a subset of the through holes are connected to the external power source. The LED module receives electricity if a corresponding subset of the conductive columns are electrically connected to the subset of the through holes. Specifically, the back cover may have multiple conductive columns and the installation bracket have multiple corresponding through holes. Not every pair of through holes and the conductive columns needs to provide electrical connection. For example, if there are four through holes and conductive columns. Only two through holes are connected to two terminals of the external power source. The other two through holes only provide structure connection for the top cover. The four conductive columns may all have electrical connection to the LED modules, but only two of the four conductive columns are actually electrically connected to the two through holes.

With such design, users do not need to identify the two through holes with electricity, but only need to place the four conductive columns into the four through holes. However, there are two conductive columns forming electrical connection to the two through holes actually connected to the external power source.

Figure 9:
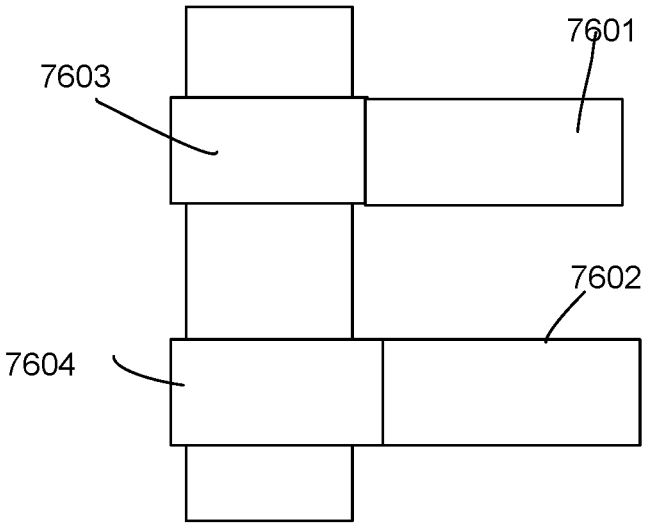
FIG. 9 illustrates an embodiment of a conductive column.

In FIG. 9, the conductive column has two conductive parts 7603, 7604 respectively connecting to two terminals 7601, 7602 of the external power source.

Figure 11:
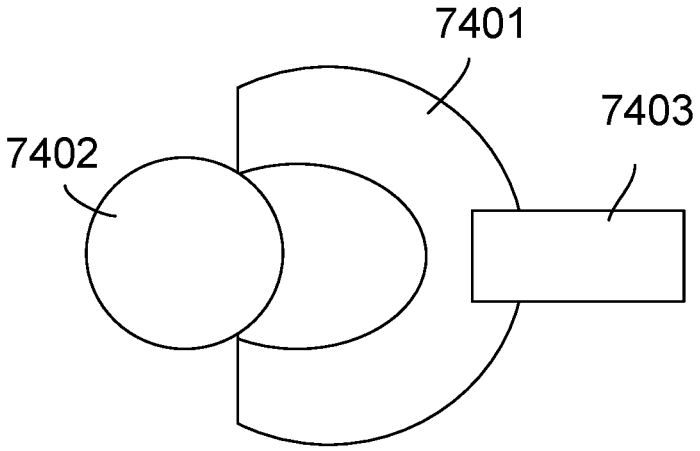
FIG. 11 illustrates a conductive clip.

In FIG. 11, the first conductive unit 7403 further includes an elastic conductive clip 7401 clipping the conductive column 7402 for enhancing contact between the conductive column of the second conductive unit to the first conductive unit.

Figure 10:
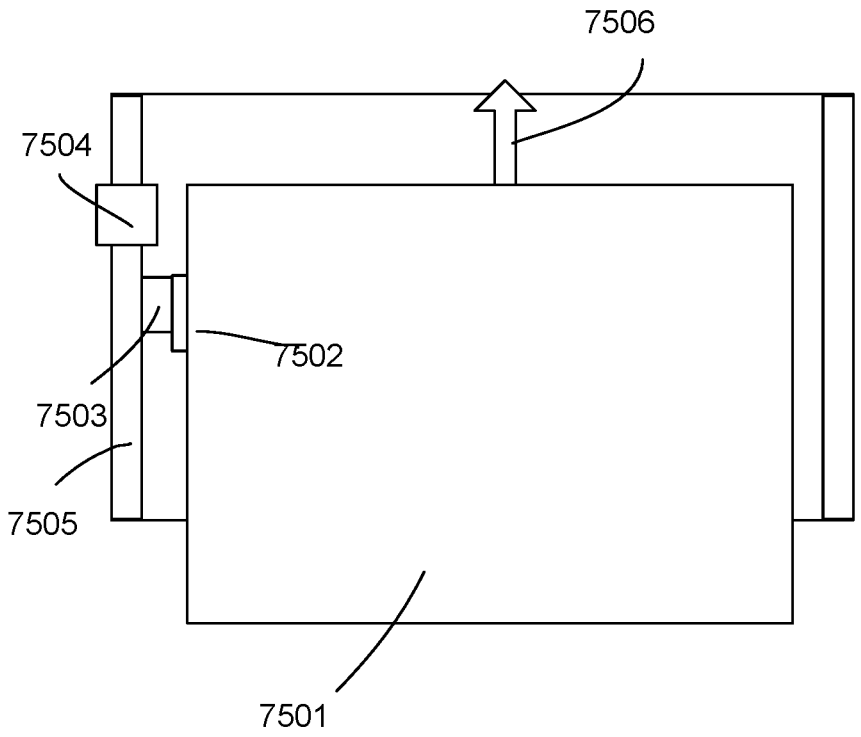
FIG. 10 illustrates another embodiment.

In FIG. 10, the through hole is disposed on a lateral wall 7505 of the installation bracket and the conductive column 7503 has an elastic unit 7502 for extending the conductive column 7503 into the through hole 7504. Specifically, the conductive column is pressed to move along the lateral wall and then enters the through hole by releasing the elastic force of the elastic unit.

In some embodiments, the first conductive unit includes a conductive column on a second side of the installation bracket. The conductive column is connected to an external power source from a first side of the installation bracket. The second conductive unit includes a through hole for the conductive column to pass through. This is not shown in the drawing, but would be understood for persons of ordinary skilled in the art, because it is a symmetric relation to invert the design in FIG. 8 to the opposite way based on the teaching provided here.

Figure 4:
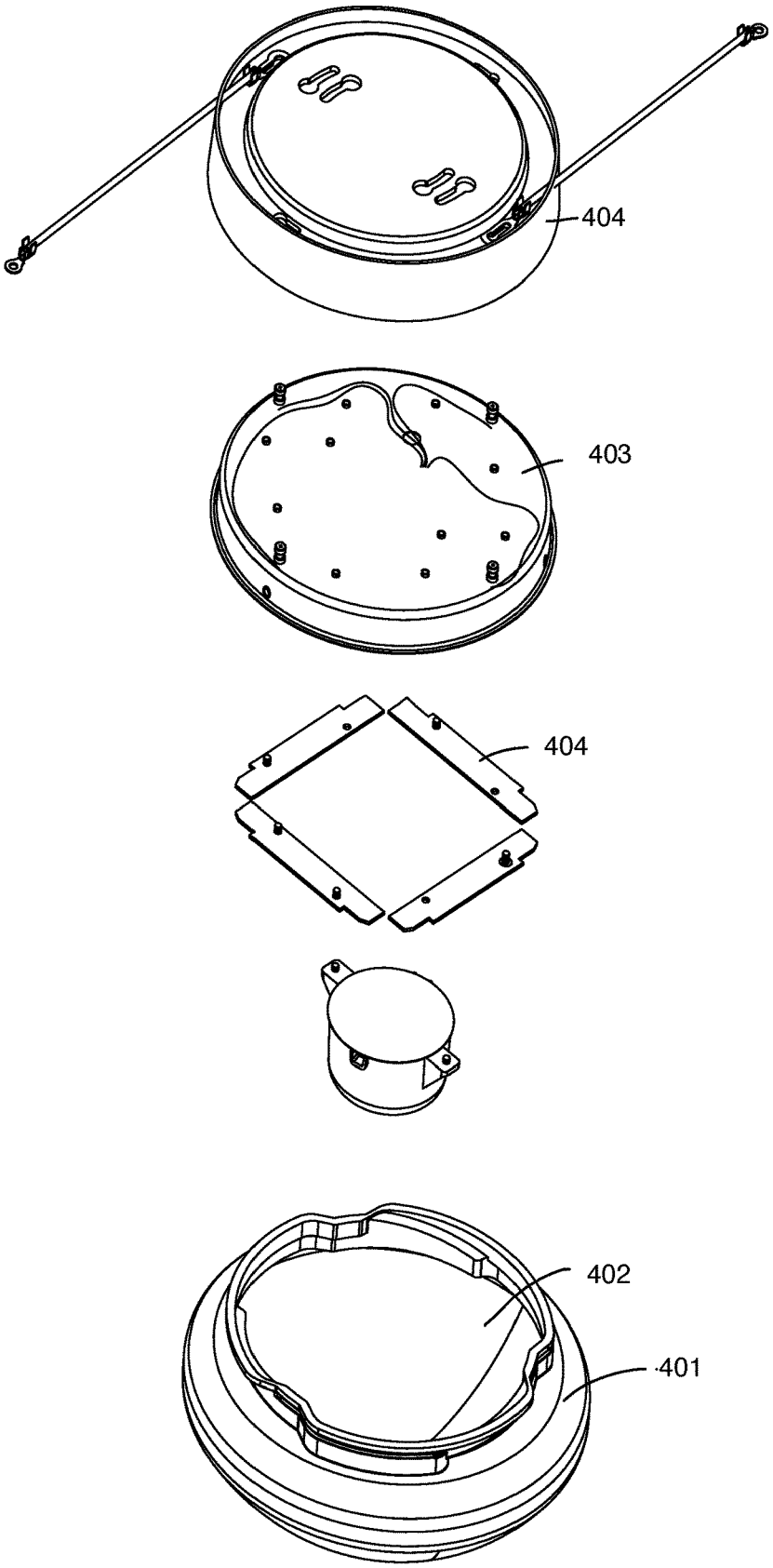
FIG. 4 illustrates an exploded view of an embodiment.

In FIG. 4, the light body further includes a lateral wall 401 and a light passing cover 402. The lateral wall 401, the light passing cover 402 and the top cover 403 together form a container space for storing the LED module 404 to emit the light passing through the light passing cover 402. Specifically, such embodiment may form a panel light.

In some embodiments, the light body has a reflective cup 701 and a light opening 702. The light of the LED module is selected by the reflective cup 701 escaping from the light opening 702. Specifically, the embodiment is a downlight apparatus like the example of FIG. 7.

In some embodiments, the installation bracket has a dorm part 703 and a surface rim 704. The light body 705 is placed inside the dorm part 703.

In FIG. 8, the lighting apparatus may also include a driver 7721 disposed on the first side 7711 of the installation bracket 7702.

In FIG. 8, the lighting apparatus may also include a driver 7722 disposed between the top cover 7705 and the installation bracket 7702.

In some embodiments, the installation bracket has a lateral wall surrounding the light body like the example shown in FIG. 1. Such design encloses the light body and provide protection for the light body.

In FIG. 8, the light body has a collectable handle 7723 for rotating the top cover with respect to the installation bracket. For example, a foldable handle may be folded to be collected to a bottom surface of the light body. When the light body is to be installed, the foldable handle is unfolded for a hand of a user to hold for rotating the light body with respect to the installation bracket.

In FIG. 1, a lighting apparatus is illustrated. The installation bracket 1 has four installation holes 1771 for installing to ceiling with screws.

Two wires 121, 122 are connected to a first conductive unit 11. There is a top cover 2 with four conductive columns 21. Some are connected to wires 221, 222 further connecting to LED modules via a hole 25.

FIG. 2 illustrates a zoom-up view of the area A in FIG. 1. In FIG. 2, the wire 122 is clipped by a wiring structure 111 with a first part 1112 for clipping an insulated part of the wire 122 and a second part 1111 for clipping a conductive part of the wire 122. The conductive part of the wire 122 is further connected to a conductive piece 11 of the first conductive unit on an installation bracket 1. There is a through hole 13 leading to a narrow groove 1102. The through hole 1101 and the groove 1102 form an opening for inserting and locking the conductive column mentioned above.

FIG. 4 shows a type of lighting apparatus that may adopt the design mentioned above.

Figure 5:
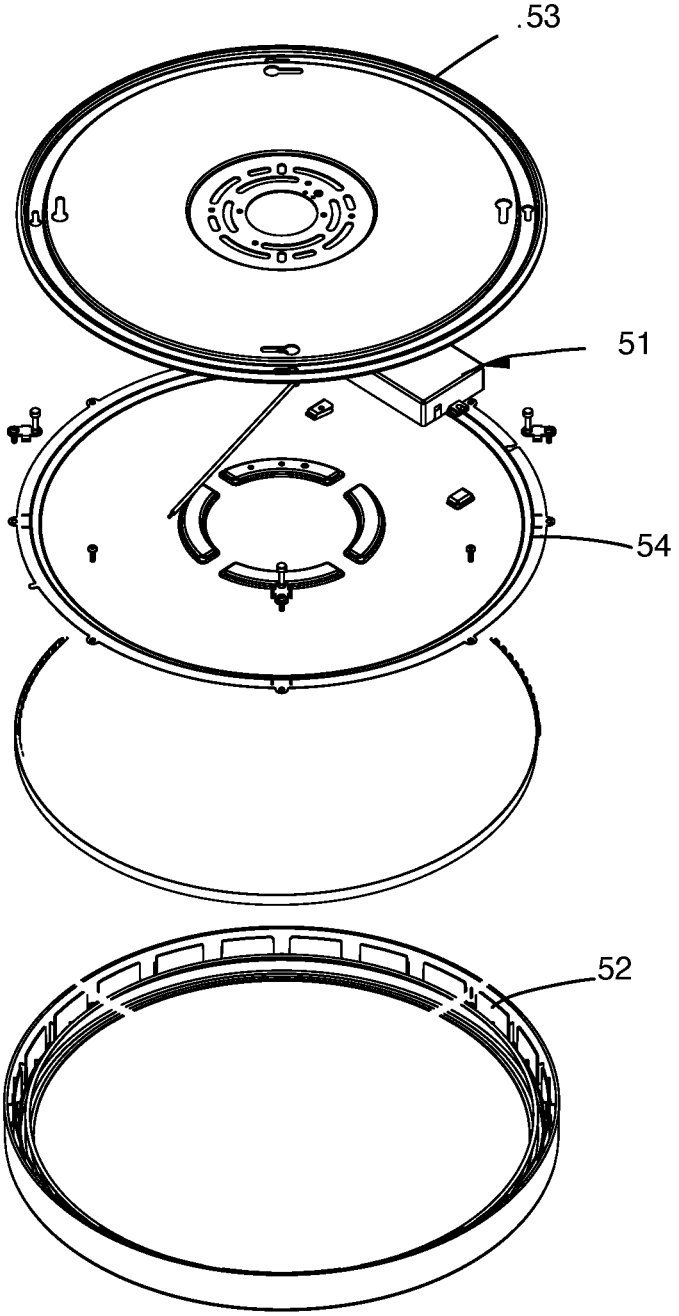
FIG. 5 illustrates an exploded view of another embodiment.

FIG. 5 illustrates another type of lighting apparatus that has a driver 51 and a surrounding LED module 52. In this example, the lighting apparatus also has an installation bracket 53 and a top cover 54 with corresponding structures mentioned above.

Figure 6:
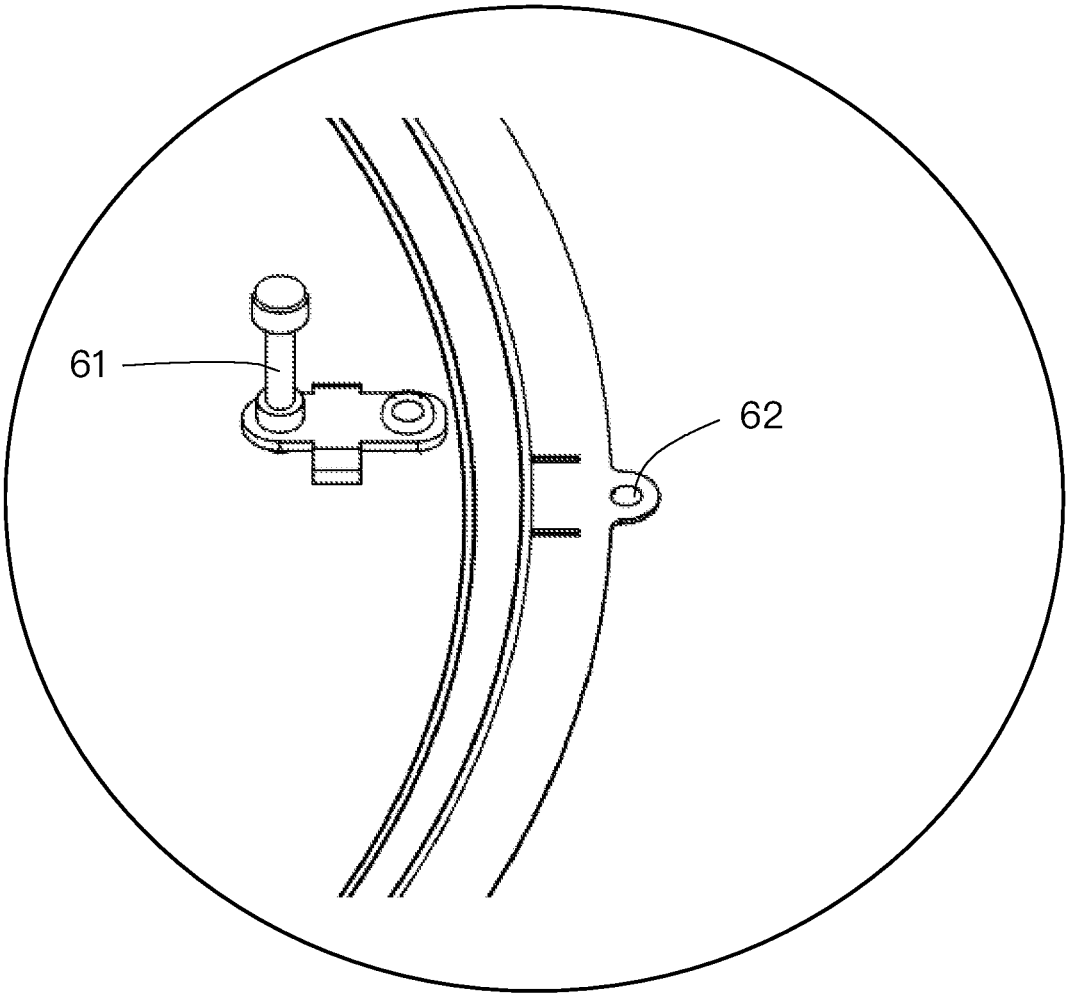
FIG. 6 illustrates a conductive column being installed to a top cover.

FIG. 6 shows a zoom-up view of a conductive column 61 example, in which the conductive column 61 may be fixed to a screw hole 62 of a top cover.

Figure 7:
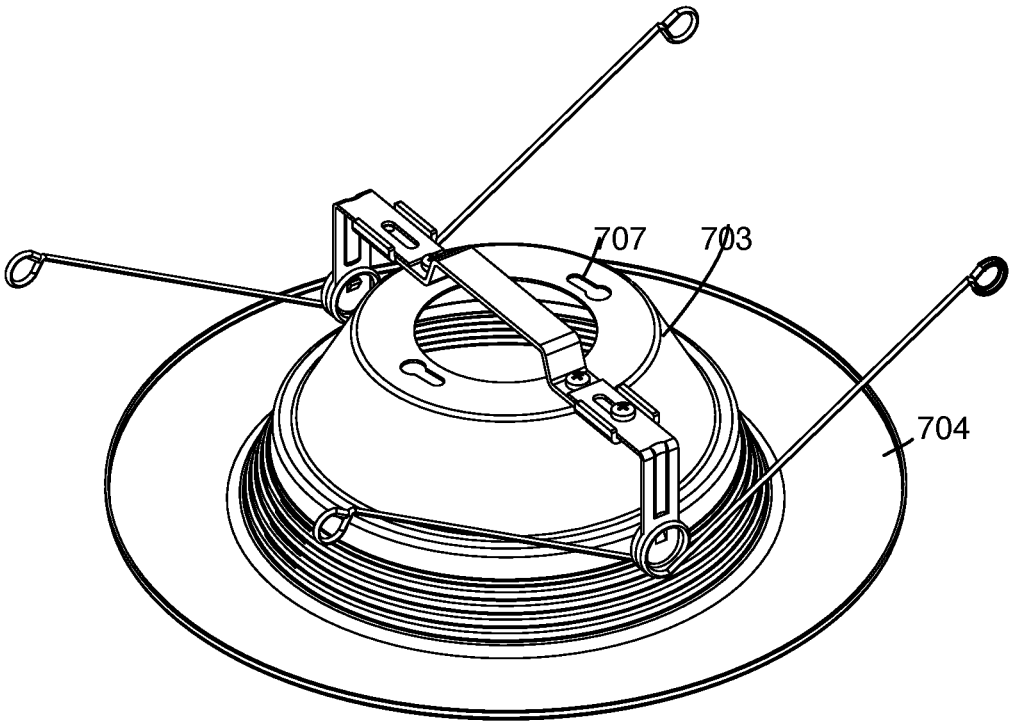
FIG. 7 illustrates a downlight embodiment.
Figure 7:
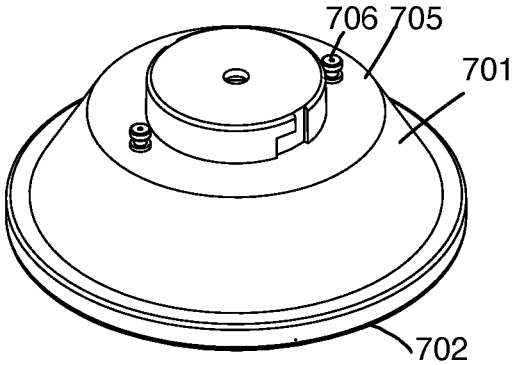

FIG. 7 shows a downlight embodiment that may use the design mentioned above.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a first conductive unit for connecting to an external power source;

an installation bracket for fixing to an installation platform, the first conductive unit being disposed on a first side of the installation bracket;

a second conductive unit;

a light body comprising a LED module for emitting a light; and a top cover for disposing the second conductive unit and the light body, the LED module being electrically connected to the external power source via the second conductive unit and the first conductive unit, wherein the top cover is detachably connected to the installation bracket from a second side of the installation bracket, the second side of the installation bracket is opposite to the first side of the installation bracket, wherein the first conductive unit comprises a through hole and a socket for connecting to a wire of the external power source, and the second conductive unit comprises a conductive column, wherein there are multiple through holes corresponding to multiple conductive columns, the multiple through holes are disposed symmetrically on the installation bracket, wherein only a subset of the through holes are connected to the external power source, and the LED module receives electricity if a corresponding subset of the conductive columns are electrically connected to the subset of the through holes, wherein only a subset of the through holes are connected to the external power source, and the LED module receives electricity if a corresponding subset of the conductive columns are electrically connected to the subset of the through holes.

2. The lighting apparatus of claim 1, wherein the first conductive unit further comprises a conductive groove with a smaller diameter than the through hole, the conductive groove being electrically connected to the socket.

3. The lighting apparatus of claim 1, wherein the conductive column has a bolt head for passing through the through hole from the second side of the installation bracket to the first side of the installation bracket and is rotated along the conductive groove to keep the bolt head above the conductive groove.

4. The lighting apparatus of claim 3, wherein the conductive column has a neck portion and a shoulder portion, the neck portion has a smaller dimension than the shoulder portion, the neck portion is kept in the conductive groove.

5. The lighting apparatus of claim 1, wherein the first conductive unit further comprises a wiring structure for connecting to a wire of the external power source.

6. The lighting apparatus of claim 5, wherein the wiring structure comprises a first part clipping an insulation layer of the wire and a second part clipping a conductive part of the wire.

7. The lighting apparatus of claim 1, wherein the conductive column has two conductive parts respectively connecting to two terminals of the external power source.

8. The lighting apparatus of claim 1, wherein the first conductive unit further comprises an elastic conductive clip clipping the conductive column.

9. The lighting apparatus of claim 1, wherein the through hole is disposed on a lateral wall of the installation bracket and the conductive column has an elastic unit for extending the conductive column into the through hole.

10. The lighting apparatus of claim 1, wherein the first conductive unit comprises a conductive column on a second side of the installation bracket, the conductive column being connected to an external power source from a first side of the installation bracket, the second conductive unit comprises a through hole for the conductive column to pass through.

11. The lighting apparatus of claim 1, wherein the light body further comprises a lateral wall and a light passing cover, the lateral wall, the light passing cover and the top cover together form a container space for storing the LED module to emit the light passing through the light passing cover.

12. The lighting apparatus of claim 1, wherein the light body has a reflective cup and a light opening, the light of the LED module is selected by the reflective cup escaping from the light opening.

13. The lighting apparatus of claim 12, wherein the installation bracket has a dorm part and a surface rim, the light body is placed inside the dorm part.

14. The lighting apparatus of claim 1, further comprising a driver disposed on the first side of the installation bracket.

15. The lighting apparatus of claim 1, further comprising a driver disposed between the top cover and the installation bracket.

16. The lighting apparatus of claim 1, wherein the installation bracket has a lateral wall surrounding the light body.

17. The lighting apparatus of claim 1, wherein the light body has a collectable handle for rotating the top cover with respect to the installation bracket.

* * * * *